US007011257B2

(12) United States Patent
Heyse

(10) Patent No.: US 7,011,257 B2
(45) Date of Patent: Mar. 14, 2006

(54) FUEL INJECTION VALVE

(75) Inventor: Jörg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 189 days.

(21) Appl. No.: 10/333,287

(22) PCT Filed: May 7, 2002

(86) PCT No.: PCT/DE02/01633

§ 371 (c)(1),
(2), (4) Date: Sep. 2, 2003

(87) PCT Pub. No.: WO02/095218

PCT Pub. Date: Nov. 28, 2002

(65) Prior Publication Data

US 2004/0046063 A1 Mar. 11, 2004

(30) Foreign Application Priority Data

May 21, 2001 (DE) ..... 101 24 748

(51) Int. Cl.
*F02M 59/00* (2006.01)
*F02M 61/00* (2006.01)
*B05B 1/30* (2006.01)

(52) U.S. Cl. ..... 239/533.2; 239/533.9; 239/533.12; 239/533.13; 239/585.1; 239/585.3; 239/585.5

(58) Field of Classification Search ..... 239/533.2, 239/533.3, 533.9, 533.12, 533.13, 585.1–585.5, 239/88–93; 251/129.15, 129.21, 127
See application file for complete search history.

(56) References Cited

U.S. PATENT DOCUMENTS

| | | | | |
|---|---|---|---|---|
| 4,046,322 | A * | 9/1977 | Knape et al. | 239/533.7 |
| 4,405,912 | A * | 9/1983 | Palma et al. | 335/260 |
| 4,545,352 | A * | 10/1985 | Jourde et al. | 123/447 |
| 5,752,316 | A | 5/1998 | Takagi et al. | |
| 6,382,533 | B1 * | 5/2002 | Mueller et al. | 239/585.1 |

FOREIGN PATENT DOCUMENTS

| | | |
|---|---|---|
| DE | 631 135 | 6/1936 |
| DE | 42 09 154 | 9/1992 |
| DE | 42 22 137 | 1/1994 |
| DE | 198 04 463 | 8/1999 |
| EP | 0 370 659 | 5/1990 |
| EP | 1 124 057 | 8/2001 |

* cited by examiner

*Primary Examiner*—Davis Hwu
(74) *Attorney, Agent, or Firm*—Kenyon & Kenyon

(57) ABSTRACT

A fuel injector for fuel injection systems of internal combustion engines having a magnetic coil, a valve needle, which is in operative connection with the magnetic coil and acted upon in a closing direction by a restoring spring to actuate a valve-closure member, which, together with a valve-seat surface formed at a valve-seat member, forms a sealing seat; and having at least one spray-discharge orifice which is formed in the valve-seat member. The spray-discharge orifices discharge from elevations which project beyond an outer end face of the valve-seat member, the fuel being guided through flow channels in the elevations.

9 Claims, 2 Drawing Sheets

FUEL INJECTION VALVE

BACKGROUND INFORMATION

From German Patent Application No. DE 198 04 463, a fuel-injection system for a mixture-compressing internal combustion engine having external ignition is known, which includes a fuel injector that injects fuel into a combustion chamber having a piston/cylinder design, and which is provided with a spark plug that projects into the combustion chamber. The fuel injector is provided with at least one row of injection orifices distributed across the circumference of the fuel injector. Fuel is selectively injected via the injection orifices to implement a jet-controlled combustion method in that a mixture cloud is formed using at least one jet.

A disadvantage of the fuel injector known from the above-mentioned printed publication, in particular, is the deposit formation on the spray-discharge orifices. These deposits clog the orifices and cause an unacceptable reduction in the flow rate through the fuel injector, thereby leading to malfunctions of the internal combustion engine.

SUMMARY OF THE INVENTION

The fuel injector according to the present invention has the advantage over the related art that the spray-discharge orifices are designed in such a way that toroidal elevations, which project beyond the external end face of the valve-seat member, enclose flow channels in which the fuel is guided to the spray-discharge orifices. The spray-discharge orifices discharge into the combustion chamber of the internal combustion engine.

The diameter of the flow channels advantageously tapers toward the spray-discharge orifices, so that the flow in the flow channels is not interrupted.

In addition to a trumpet-shaped or cone-shaped tapering, a spherical form, which initially widens and then tapers again, is likewise advantageous for the form of the flow channels.

A straight, cylindrical form of the flow channels is particularly advantageous since it is able to be produced in a simple and cost-effective manner.

The spray-discharge orifices may be produced in an uncomplicated manner by using a mandrel, which pierces the valve-seat member in the direction of the flow. The form of the flow channels is easy to model by the form of the mandrel.

The use of a die plate makes it possible to form the edge at the spray-discharge orifices; an edge tapering to a sharp point is particularly advantageous because of the limited surface for coke deposition.

The coking tendency is also advantageously influenced by a wider infeed radius, which is created in the production of the spray-discharge orifices.

DETAILED DESCRIPTION

Figure 1:
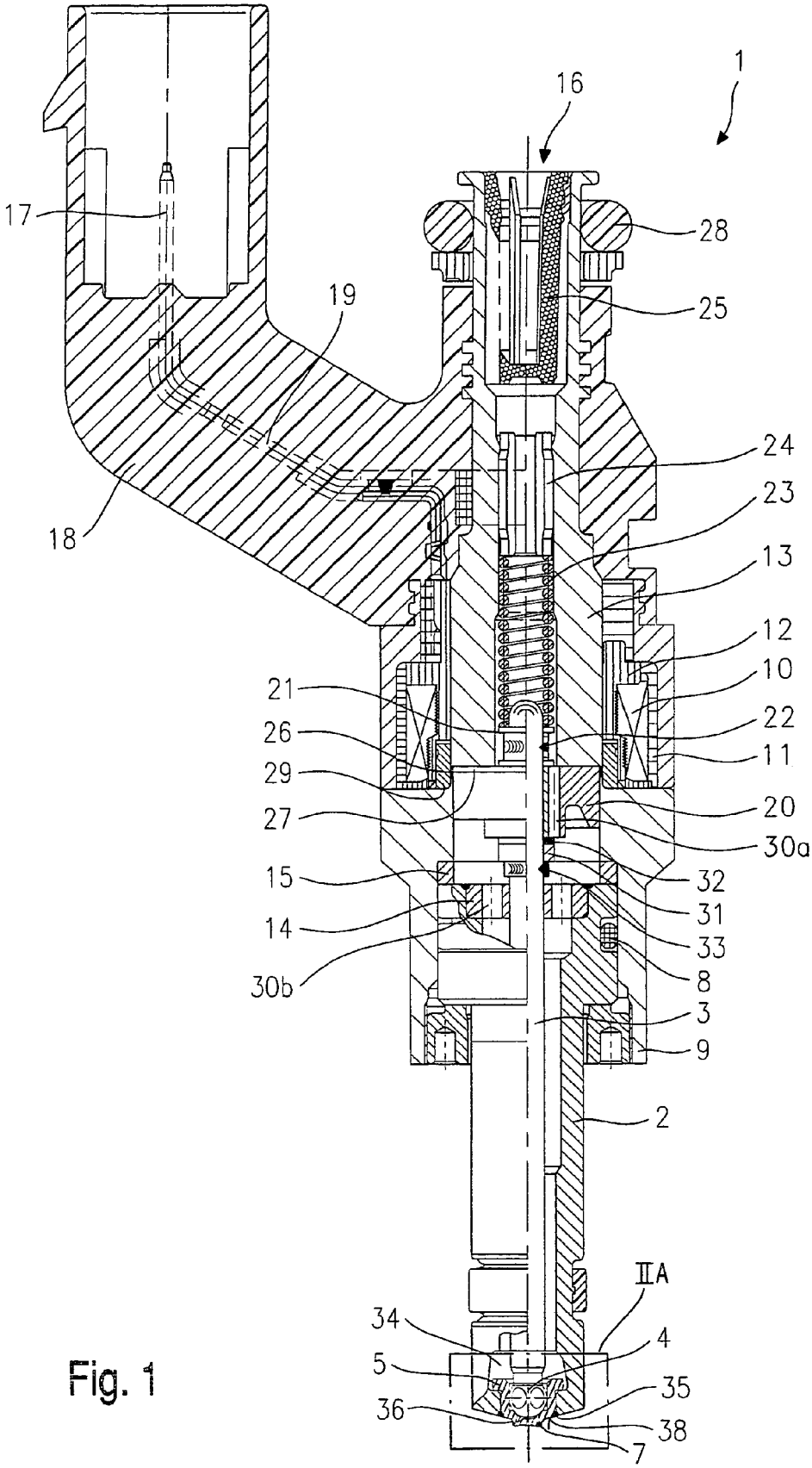
FIG. 1 shows a schematic section through a first exemplary embodiment of a fuel injector configured according to the present invention, in an overall view.

In a part-sectional representation, FIG. 1 shows a first exemplary embodiment of a fuel injector 1 according to the present invention. It is in the form of a fuel injector 1 for fuel-injection systems of mixture-compressing internal combustion engines having external ignition. Fuel injector 1 is suitable for the direct injection of fuel into a combustion chamber (not shown) of an internal combustion engine.

Fuel injector 1 is made up of a nozzle body 2 in which a valve needle 3 is positioned. Valve needle 3 is in operative connection with a valve-closure member 4, which cooperates with a valve-seat surface 6 disposed on a valve-seat member 5 to form a sealing seat. In the exemplary embodiment, fuel injector 1 is an inwardly opening fuel injector 1 which has at least one spray-discharge orifice 7.

Valve-closure member 4 of fuel injector 1 designed according to the present invention has a nearly spherical form, thereby achieving an offset-free cardanic valve-needle guidance, which provides for a precise functioning of fuel injector 1.

Valve-seat member 5 of fuel injector 1 has a nearly cup-shaped design and, by its form, contributes to the valve-needle guidance. Valve-seat member 5 is inserted into a recess 34 on the discharge side of nozzle body 2 and connected to nozzle body 2 via a welding seam 35.

Seal 8 seals nozzle body 2 from an outer pole 9 of a magnetic coil 10. Magnetic coil 10 is encapsulated in a coil housing 11 and wound on a coil brace 12, which rests against an inner pole 13 at magnetic coil 10. Inner pole 13 and outer pole 9 are separated from one another by a gap 26 and are braced against a connecting member 29. Magnetic coil 10 is energized via a line 19 by an electric current, which may be supplied via an electrical plug contact 17. A plastic coating 18, which may be extruded onto inner pole 13, encloses plug contact 17.

Valve needle 3 is guided in a valve-needle guide 14, which is disk-shaped. A paired adjustment disk 15 is used to adjust the (valve) lift. On the other side of adjustment disk 15 is an armature 20 which, via a first flange 21, is connected by force-locking to valve needle 3, which is connected to first flange 21 by a welding seam 22.

Braced against first flange 21 is a restoring spring 23 which, in the present design of fuel injector 1, is prestressed by a sleeve 24.

On the discharge-side of armature 20 is a second flange 31 which is used as lower armature stop. It is connected via a welding seem 33 to valve needle 3 in force-locking manner. An elastic intermediate ring 32 is disposed between armature 20 and second flange 31 to damp armature bounce during closing of fuel injector 1.

Fuel channels 30*a* through 30*c* run in valve-needle guide 14, in armature 20 and valve-seat member 5. The fuel is supplied via a central fuel feed 16 and filtered by a filter element 25. Fuel injector 1 is sealed from a distributor line (not shown further) by a seal 28.

According to the present invention, fuel injector 1 has elevations 36 at valve-seat member 5 disposed in a recess 34 of nozzle body 2 and is connected to it, for example, by a welding seam 35. Flow channels 39, which discharge into spray-discharge orifices 7, run in elevations 36. Elevations 36 are formed at an external end face 38 of valve-seat member 5. As a result of their special form and configuration, they reduce the tendency of deposits forming in spray-discharge orifices 7, thereby preventing malfunctions of fuel injector 1, due to clogging of spray-discharge orifices 7, and an unacceptable reduction in the fuel flow. The discharge-side part of fuel injector 1 is illustrated and explained in greater detail in the following figures.

In the rest state of fuel injector 1, restoring spring 23 acts upon first flange 21 at valve needle 3, contrary to its lift direction, in such a way that valve-closure member 4 is retained in sealing contact against valve seat 6. Armature 20 rests on intermediate ring 32, which is supported on second flange 31. When magnetic coil 10 is energized, it builds up a magnetic field which moves armature 20 in the lift direction against the spring tension of restoring spring 23. Armature 20 carries along first flange 21, which is welded to valve needle 3, and thus valve needle 3, in the lift direction as well. Valve-closure member 4, being in operative connection with valve needle, lifts off from valve seat surface 6, thereby spray-discharging fuel at spray-discharge openings 7.

When the coil current is turned off, once the magnetic field has sufficiently decayed, armature 20 falls away from internal pole 13, due to the pressure of restoring spring 23 on first flange 21, whereupon valve needle 3 moves in a direction counter to the lift. As a result, valve closure member 4 comes to rest on valve-seat surface 6, and fuel injector 1 is closed. Armature 20 comes to rest against the armature stop formed by second flange 31.

Figure 2A:
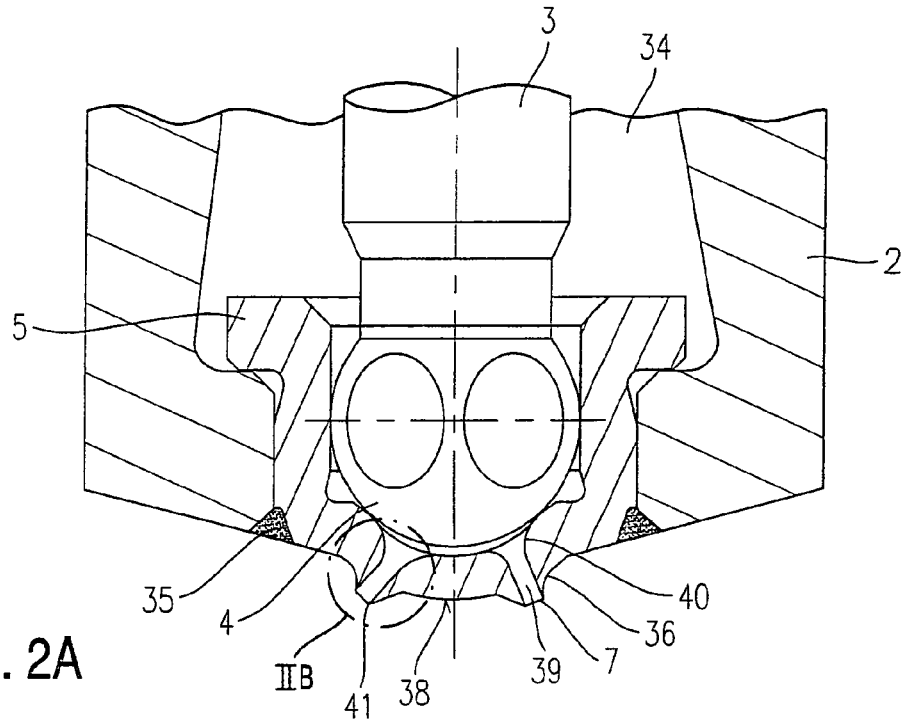
FIG. 2A shows a schematic section through the discharge-side part of the first exemplary embodiment of the fuel injector, designed according to the present invention as represented in FIG. 1, in region IIA in FIG. 1.

FIG. 2A, in a part-sectional representation, shows the section designated IIA in FIG. 1 of the first exemplary embodiment of a fuel injector 1, designed according to the present invention, as shown in FIG. 1.

In the described first exemplary embodiment, as already briefly mentioned in FIG. 1, valve-seat member 5, at its outer end face 38 facing the combustion chamber, is provided with elevations 36 in which flow channels run that discharge into spray-discharge orifices 7.

In the present exemplary embodiment, spray-discharge orifices 7 are formed in the outer end face 38 of valve-seat member 5. Spray-discharge orifices 7 in valve-seat member 5 may be implemented as desired. They are preferably disposed on a plurality of round or elliptical hole circles, which may be in concentric or eccentric arrangement with respect to one another, or on a plurality of straight or curved hole circles, which are arranged in parallel, at an angle or offset with respect to one another. The clearance between the center points of the holes may be of equal size or may vary, but should amount to at least one hole diameter for reasons of production engineering. The spatial orientation may vary for each hole axis, as indicated in FIG. 2A for two spray-discharge orifices 7.

Elevations 36 project beyond outer end face 38 of valve-seat member 5 in a dome-like to a tubular manner. Spray-discharge orifices 7 are produced with the aid of a hardened mandrel piercing the material of valve-seat member 5, thereby producing elevations 36 which surround spray-discharge orifices 7. By an arbitrary shape of the mandrel, different forms and cross-sections of the spray-discharge orifices may be produced, as illustrated in FIGS. 2B and 2C.

Figure 2B:
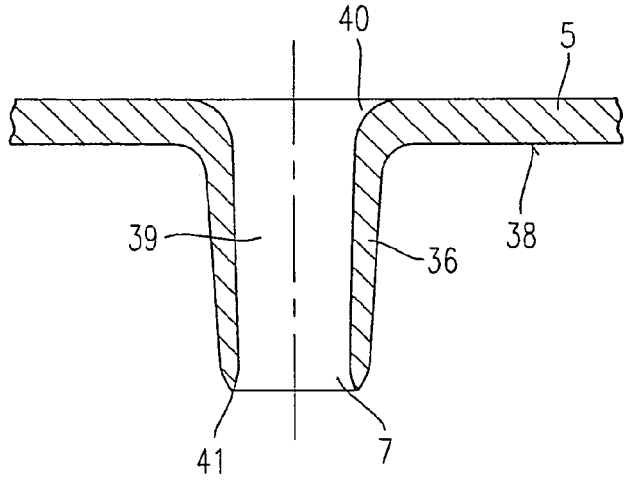
FIGS. 2B and 2C show an enlarged representation of two exemplary embodiments of spray-discharge orifices in the region IIB in FIG. 2A.
Figure 2C:
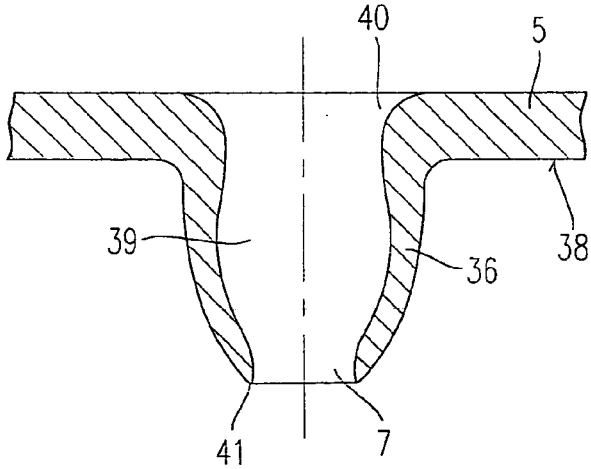

FIG. 2B shows a cross-sectional form of spray-discharge orifice 7 tapering in the discharge direction of the fuel in the manner of a trumpet, whereas FIG. 2C shows a spherical cross-section, which likewise tapers in the direction of the flow, when viewed overall. It is also possible for spray-discharge orifices 7 to widen in the discharge direction of the flow.

Deposit formation in spray-discharge orifices 7 may be reduced by the special form and arrangement of spray-discharge orifices 7. Since the diameter of spray-discharge orifices 7 typically amounts to approximately 100 $\mu$m, the danger of spray-discharge orifices 7 getting clogged over time and the flow rate being restricted to an unacceptable degree, due to the formation of deposits, is relatively high. The tapering form of flow channels 39 in elevations 36 increases the flow velocity of the fuel in the flow direction, thereby preventing an interruption in the flow in spray-discharge orifice 7. Since they are in contact with the flow, flow channels 39 and spray-discharge orifices 7 are protected from deposit formations, so that spray-discharge orifices 7 are unable to become clogged by coke residue.

Since spray-discharge orifices 7 discharge above outer end face 38 of valve-seat member 5 in a projecting manner into the combustion chamber (not shown further), deposits forming on outer end face 38 of valve-seat member 5 do not enter spray-discharge orifices 7, but are delimited by the toroidal elevations 36 of spray-discharge orifices 7.

In the region where elevations 36 curve upwards, the production process results in an infeed radius 40 which is advantageous for avoiding a flow detachment in flow channel 39.

A die plate (not shown further) may be used to influence the formation of elevations 36 in that elevations 36 are clamped between the die plate and the mandrel. This makes it possible to form an edge 41 of elevations 36 with any desired design. In FIGS. 2B and 2C, edge 41 tapers to a sharp point in each case, so that deposits of coke residue are avoided, due to the very limited surface area of edge 41.

The present invention is not limited to the exemplary embodiments shown, but is also applicable, for instance, to spray-discharge orifices 7 of any desired configuration, to flow channels 39 extending in a conical or cylindrical fashion, as well as to any desired design types of inwardly-opening fuel injectors 1.

What is claimed is:

1. A fuel injector for a fuel injection system of an internal combustion engine, comprising:

a valve-seat member having an outer end face;

a valve-seat surface formed at the valve-seat member;

a valve-closure member which, together with the valve-seat surface, forms a sealing seat;

an energizable actuator;

a valve needle in operative connection with the actuator;

a restoring spring acting upon the valve needle in a closing direction to actuate the valve-closure member; and at least one spray-discharge orifice formed in the valve-seat member, the at least one spray-discharge orifice discharging from elevations which project beyond the outer end face of the valve-seat member, the fuel being guided through flow channels in the elevations, wherein the flow channels in the elevations taper toward the spray-discharge orifice in a discharge direction of the fuel.

2. The fuel injector according to claim 1, wherein the flow channels taper in the shape of a trumpet.

3. The fuel injector according to claim 1, wherein the flow channels widen in a spherical shape and taper toward the spray-discharge orifice.

4. The fuel injector according to claim 1, wherein the flow channels taper conically toward the spray-discharge orifice.

5. The fuel injector according to claim 1, wherein the flow channels extend through the elevations in a cylindrical manner.

6. The fuel injector according to claim 1, wherein the elevations have a convex shape provided by a mandrel during production of the spray-discharge orifice.

7. The fuel injector according to claim 1, wherein an infeed radius of the flow channels is formed at an inflow-side end of the flow channels.

8. The fuel injector according to claim 1, wherein an edge is formed at the elevations in a region of the spray-discharge orifice.

9. The fuel injector according to claim 8, wherein the edge has a design that tapers to a point.

* * * * *